US005696541A

United States Patent [19]

Akahane et al.

[11] Patent Number: 5,696,541

[45] Date of Patent: Dec. 9, 1997

[54] MECHANISM AND METHOD FOR ADJUSTMENT OF HEAD POSITION IN INK-JET PRINTER

[75] Inventors: Fujio Akahane; Tatsuya Seshimo, both of Nagano, Japan

[73] Assignee: Seiko Epson Corporation, Tokyo, Japan

[21] Appl. No.: 412,258

[22] Filed: Mar. 28, 1995

[30] Foreign Application Priority Data

Mar. 28, 1994 [JP] Japan ..... 6-057555
Mar. 16, 1995 [JP] Japan ..... 7-084673

[51] Int. Cl.[6] ..... B41J 25/308

[52] U.S. Cl. ..... 347/8

[58] Field of Search ..... 347/8, 43, 49; 400/55–60

[56] References Cited

U.S. PATENT DOCUMENTS 4,774,529 9/1988 Paranjpe et al. ..... 347/43
5,455,607 10/1995 Rhoads et al. ..... 347/8

FOREIGN PATENT DOCUMENTS 0 516 188 12/1992 European Pat. Off. ..... B41J 2/045
4-361045 12/1992 Japan ..... B41J 2/045
5-261918 10/1993 Japan ..... B41J 2/045

*Primary Examiner*—Benjamin R. Fuller
*Assistant Examiner*—L. Anderson
*Attorney, Agent, or Firm*—Stroock & Stroock & Lavan LLP

[57] ABSTRACT

A head positioning adjustment mechanism for an ink jet printer includes a carriage, which moves within the printer and a print head having an engagement portion and nozzles. The carriage includes a head positioning surface for determining a head position in a direction of paper feed, and a head guide groove, which engages the engagement portion of the head. The head includes an abutment surface for contacting the head positioning surface, and is biased against the head positioning surface by a spring. The nozzles are adjusted to a position parallel to the paper feed direction by interposing a rotation correction plate between the abutment surface and the head positioning surface.

11 Claims, 5 Drawing Sheets

MECHANISM AND METHOD FOR ADJUSTMENT OF HEAD POSITION IN INK-JET PRINTER

BACKGROUND OF THE INVENTION

1. Field of the Invention

This invention relates to a serial ink-jet printer of the on-demand type which injects ink droplets onto a recording medium to form an image of ink thereon, and more particularly, to a mechanism for and a method for adjusting the position of a printing head.

2. Related Art

Serial ink-jet printers are broadly classified into two types. In one type, there is used a so-called print head cartridge in which an ink cartridge and a head are integrally combined together. In the other type, there is used a so-called ink jet head, and only an ink cartridge is exchanged as a consumable part.

Generally, an ink-jet recording method has advantages that the printing can be applied directly onto a recording medium, and that a compact design of a head is possible. Further, color printing can be easily effected by changing the colors of ink by substitution of ink cartridges. However, when a plurality of ink-jet heads or print head cartridges are mounted on a common carriage, nozzles are displaced out of their optimum positions because of mechanical tolerances and mounting tolerances of the heads, so that high-quality printing can not be obtained.

Particularly in the print head cartridge in which the ink cartridge and the head are integrally combined together, the head is also exchanged when ink is exhausted, and each time such exchange is carried out, the head position need to be adjusted. This adjustment should not be imposed on users, and therefore there has been used a method in which results of test printing are read by a sensor, and then a cam is driven by an actuator so as to adjust the relative position of the head, as disclosed in Japanese Patent Unexamined Publication Nos. 5-254114, 5-278027 and 5-278306. This adjusting method has problems that the construction becomes complicated, and that each time the head is required. Accordingly, an ink jet print head of simple construction, which compensates for nozzle displacement is provided.

SUMMARY OF THE INVENTION

A head position adjusting mechanism for an ink-jet printer includes a carriage moveable in reciprocating movement between a first and second direction. The carriage has a head positioning surface for determining a head position in a direction of paper feed, the head positioning surface being parallel to the direction of reciprocating movement. A head guide groove extending perpendicular to the direction of reciprocating motion is formed in the carriage. A head including an engagement portion is engaged by the head guide groove to limit the movement of the head in the direction of reciprocating motion. Front and rear abutment surfaces formed on the head are spaced in the direction of reciprocating motion for contacting with the head positioning surface. An urging spring biases the abutment surfaces of the head against the head positioning surface.

In a head position-adjusting method, using one of the heads, abutted against the associated head positioning surface, as a reference, the other head is abutted against the associated head positioning surface utilizing a required number of adjusting plates, so that printing dots of the other head are caused to overlap printing dots of the one head in a direction of paper feed.

Accordingly, it is an object of the invention to provide an improved cartridge ink jet print head.

It is still another object of this invention to provide a mechanism for adjusting the position of a head easily and accurately, and also to provide a method of adjusting the position of the head.

Yet another object of the invention is an ink jet print head of simple construction which compensates for nozzle displacement.

Still other objects and advantages of the invention will in part be obvious and in part be apparent from the specification.

The invention accordingly comprises the features of construction, combination of elements, arrangement of parts, and combinations of steps which will be exemplified by the constructions and descriptions hereinafter set forth and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENT

Figure 1:
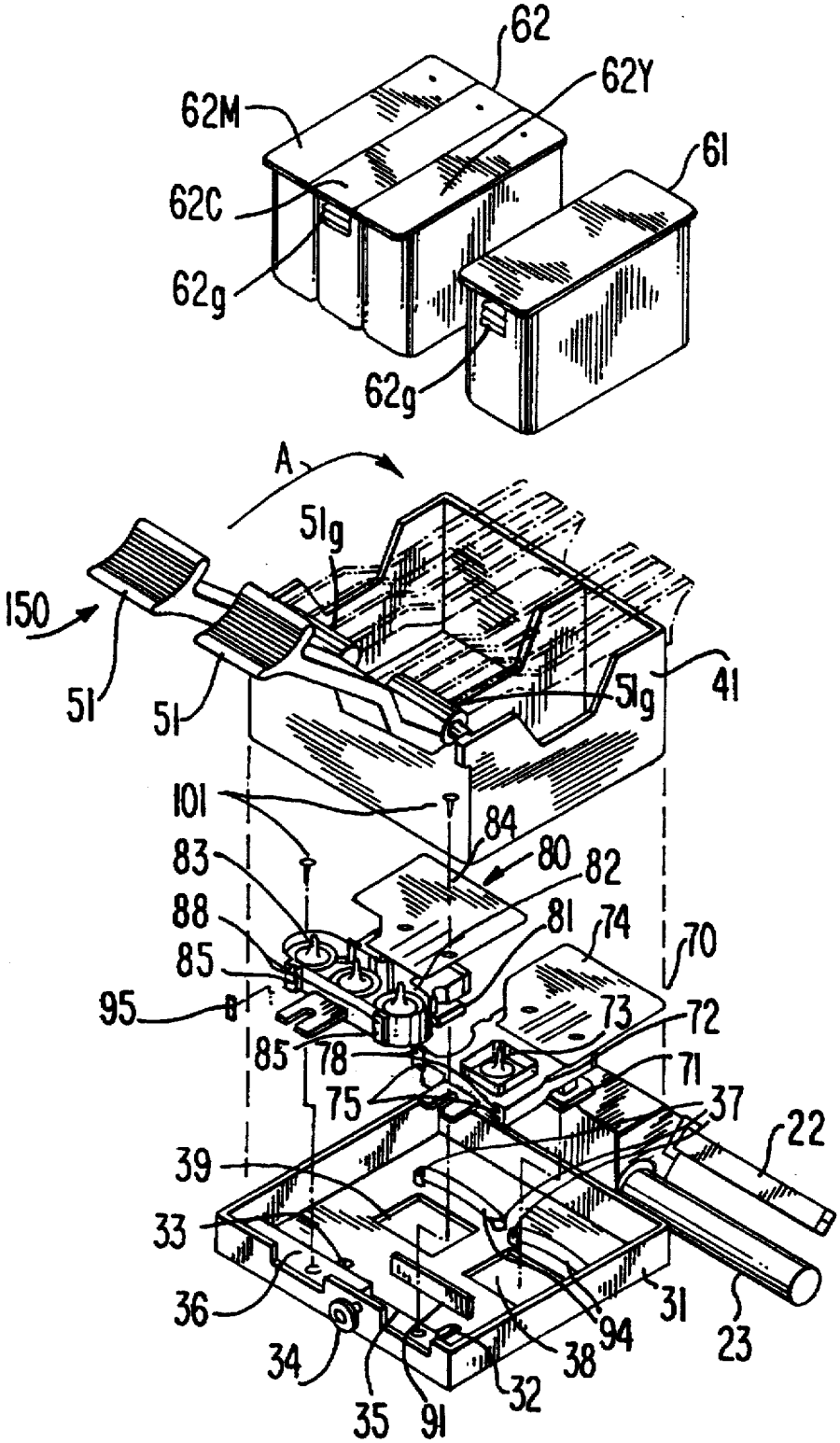
FIG. 1 is an exploded, perspective view of a portion of a color printer constructed in accordance with the present invention.

Reference is made to FIGS. 1–6 wherein an ink jet printer generally indicated as 150 is provided. Ink jet printer 150 includes a main frame 11 as well as a carriage support shaft 23. A carriage 31 is slidably mounted on carriage shaft 23 and reciprocally moves along carriage shaft 23. A belt 22 is coupled to carriage 31 and driven by a carriage motor 21 mounted on main frame 11 to move carriage 31. A driven roller 34 is mounted on carriage 31 and rolls on a surface of a paper discharge frame 12. Driven roller 34 is held in place by frame 12 and prevents carriage 31 from rotating about carriage support shaft 23. A black ink jet print head 70 and a color ink jet head 80 are mounted on carriage 31.

Color printer 150 includes paper guides 2*a*, 2*b*, 2*c* (FIG. 2) which guide a recording medium 1 towards a paper feed roller 3. Paper feed roller 3 rotates in a counterclockwise direction. A paper holder spring 6 is mounted on a support shaft 5. Paper holder rollers 4*a*, 4*b* are biased by paper holder spring 6 to cooperate with feed roller 3 to feed a recording medium 1 to be wound about paper feed roller 3. A paper holder roller 4*c* located downstream of paper roller 4*b* holds the recording medium 1 against paper feed roller 3 by its own weight. A paper discharge roller 7 downstream of paper holder roller 4*c* sends the recording medium 1 out of printer 150 when printing is finished. A discharged paper holder roller 8 holds the recording medium at its pointed distal end so that the printed surface will not become dirty.

The carriage 31 has a first head positioning surface 36 for receiving the abutment surfaces 85 of the color ink-jet head 80, and a second head positioning surface 35 for receiving the abutment surfaces 75 of the black ink-jet head 70. The first head positioning surface 36 is disposed parallel to carriage support shaft 23 serving as a reference for the movement of the carriage 31, and is disposed perpendicular to a direction of feed of recording medium 1. Second head positioning surface 35 is disposed parallel to carriage support shaft 23, and is offset parallel from first head positioning surface 36 away from shaft 23, as indicated by X in FIG. 3.

Spring reception portions 37 are formed on the carriage 31, and urging springs 94 are received in their associated spring reception portions 37 to press abutment surfaces 75 and 85 of the heads 70 and 80 against their associated head positioning surfaces 35 and 36. Head guide grooves 32 and 33 are also formed in the carriage and respectively receive the engagement portions 76 and 86 of the flow passage members 72 and 82 to respectively position the ink-jet heads 70 and 80 in the direction of scanning of the carriage 31, these head guide grooves 32 and 33 extending perpendicularly to the head positioning surfaces. A hole 38 and a hole 39 are formed in the carriage.

Black ink-jet head 70 includes an ink droplet injection portion 71, a circuit board 74, a flow passage member 72, and a stylus 73 for connection to a black ink cartridge 61 storing black ink. Ink droplet injection portion 71 extends through hole 38 to face recording medium 1.

A connector 77 is mounted on circuit board 74. A cable 201 is connected between a control circuit of a printer body (not shown) and connector 77.

Figure 4A:
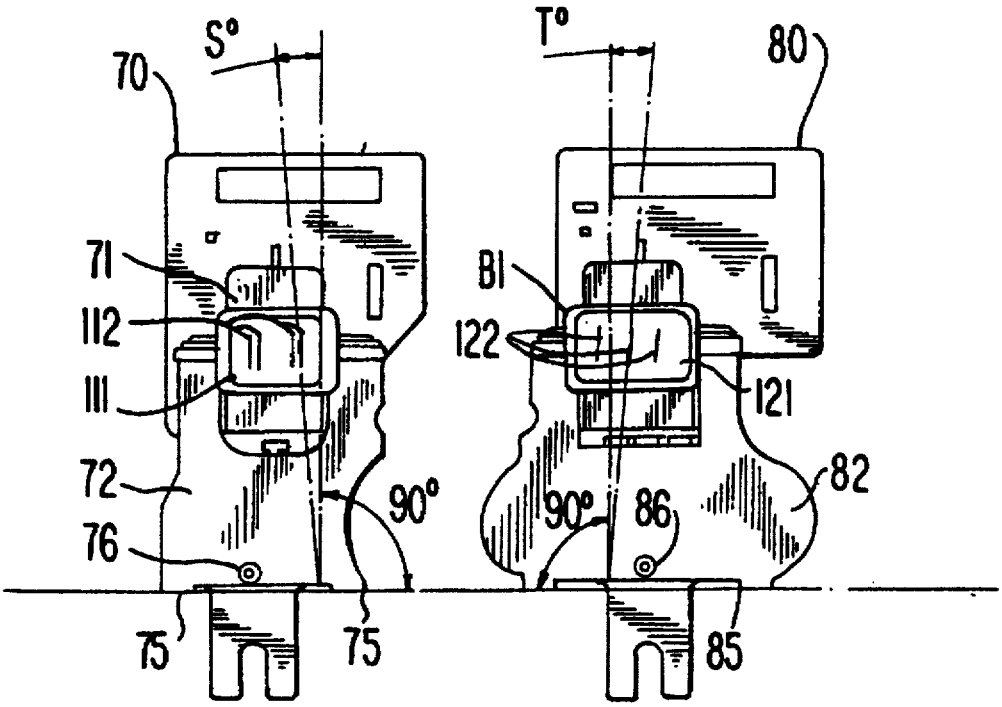
FIGS. 4*a* and 4*b* are schematic views showing a method of correcting the inclination of heads in accordance with the invention.
Figure 4B:
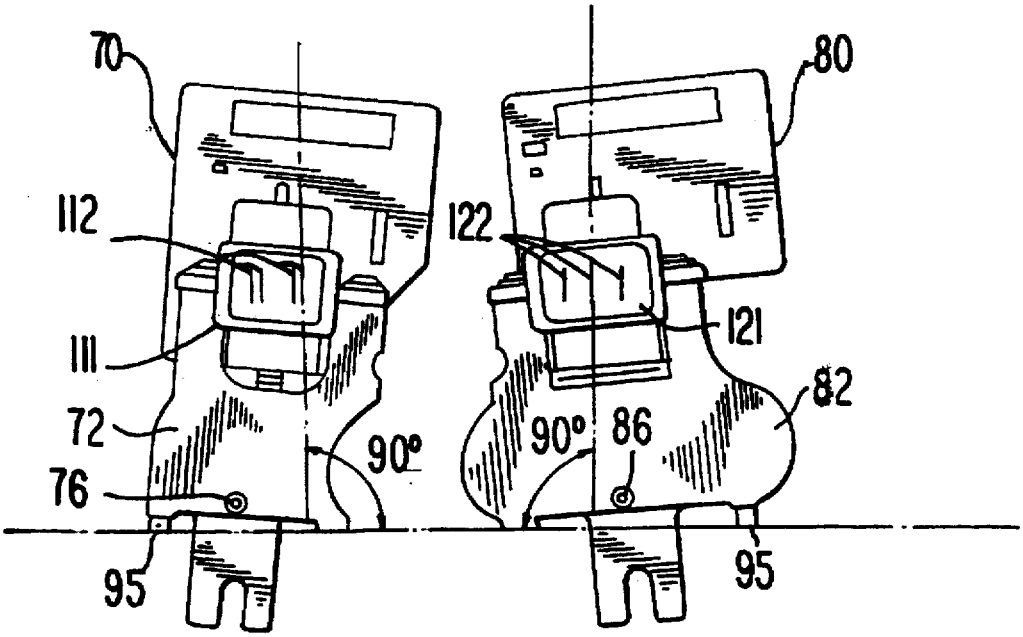
Figure 5:
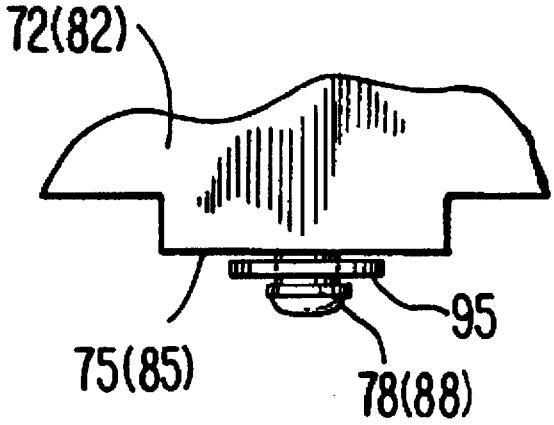
FIG. 5 is a side elevation view of a rotation correction plate mounted in accordance with the invention.
Figure 6:
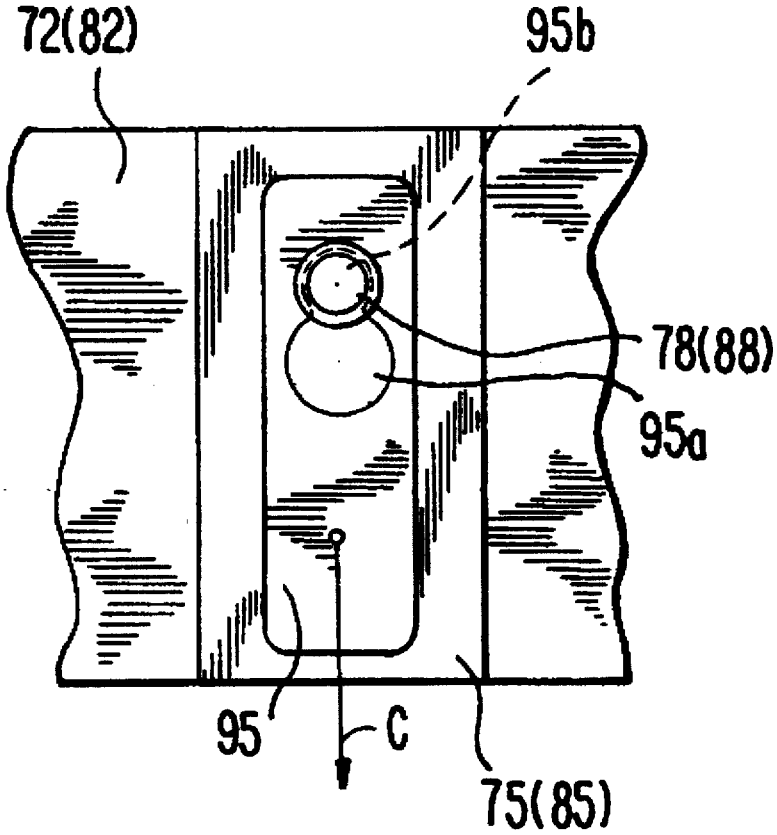
FIG. 6 is a bottom plan view of the rotation correction plate mounted in accordance with the invention.

As shown in FIG. 4, abutment surfaces 75 are formed on the flow passage member 72 in perpendicular relation to nozzles 112. Abutment surfaces are arranged in a row, and are spaced from each other in a direction of movement of a carriage 31. As shown in FIGS. 5 and 6, a hook portion 78 with a head for supporting a rotation correction plate 95 (described below) is provided on each of these surfaces. A projected engagement portion 76, engaged in a black ink-jet head guide groove 32 in the carriage 31, is formed integrally on the flow passage member 72 at that side thereof generally directed toward a paper feed roller 3.

On the other hand, a color-ink-jet head 80 includes an ink droplet injection portion 81, a circuit board 84, a flow passage member 82, and styli 83 for connection to a color ink cartridge 62. Magenta ink 62M, cyanogen ink 62C and yellow ink 62Y are stored respectively in independent chambers, and the styli 83 correspond to these colors, respectively. Ink droplet injection portion 81 extends through hole 39 of carriage 31.

A connector 87 is mounted on the circuit board 84. A cable 202 is connected between the control circuit of the printer body (not shown) and this connector 87.

As shown in FIG. 4, front abutment surface 85 is formed on the flow passage member 82 in perpendicular relation to nozzles 122 arranged in a row, and are spaced from each other in the direction of movement of the carriage 31. As shown in FIGS. 5 and 6, where like parts are drawn once, but numbered to identify both head 70, 80, a hook portion 88 (identical in structure to hook portion 78) with a head for supporting rotation correction plate 95 (described below) is provided on each of these surfaces. A projected engagement portion 86, engaged in a color ink-jet head guide groove 33 in the carriage 31, is formed integrally on the flow passage member 82 at that side thereof generally directed toward the paper feed roller.

A cartridge holder 41 is mounted on the carriage 31. This cartridge holder 41 has two levers 51 which respectively releasably hold the black ink cartridge 61 and the color ink cartridge 62 independently of each other. For attaching the ink cartridges 61 and 62, the levers 51 are held in positions shown in solid lines in FIG. 1, and in this condition the ink cartridges 61 and 62 are received in the cartridge holder 41. The levers are then pivotally moved about a lever shaft 52 in a direction of arrow A into respectively positions shown in broken lines.

Figure 2:
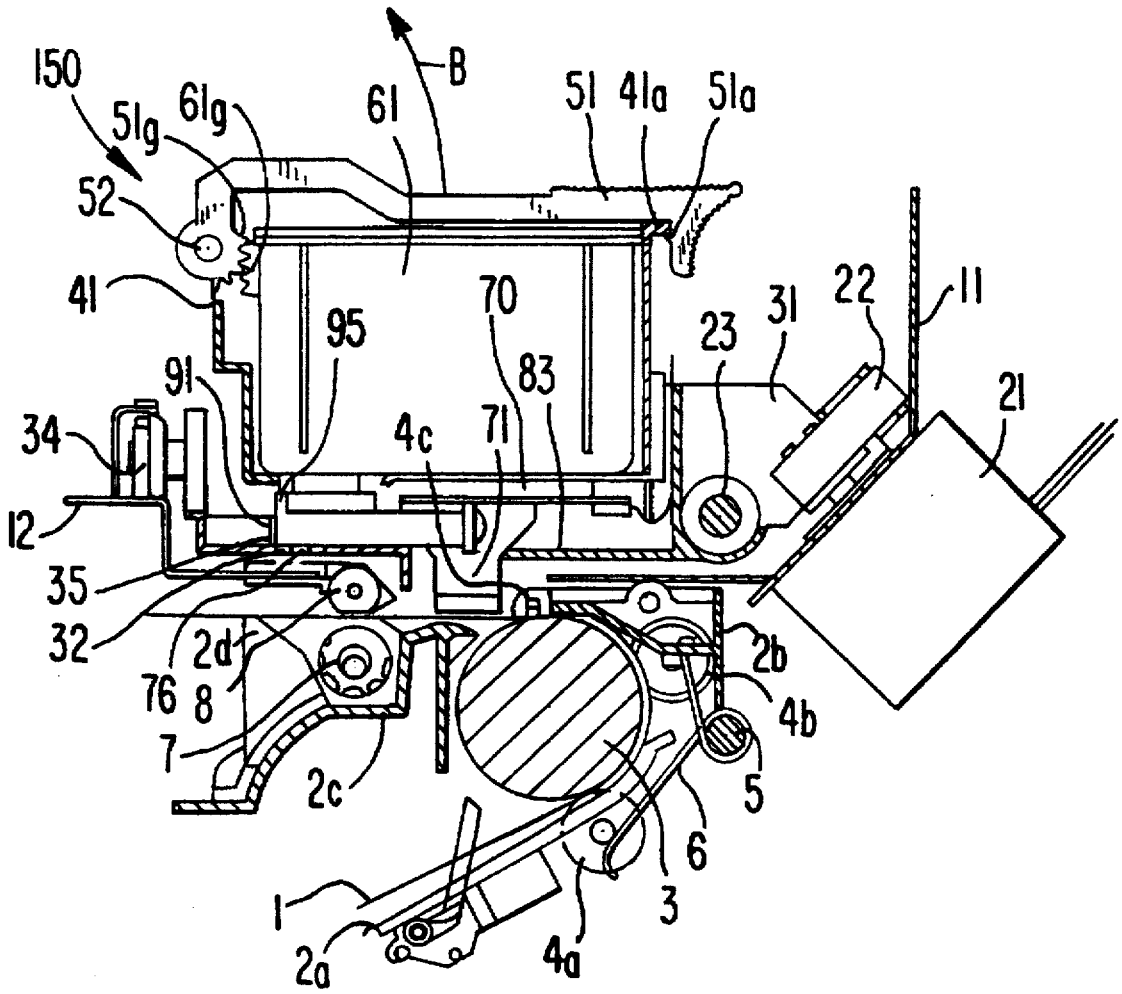
FIG. 2 is a sectional view of the color printer constructed in accordance with the present invention.
Figure 3:
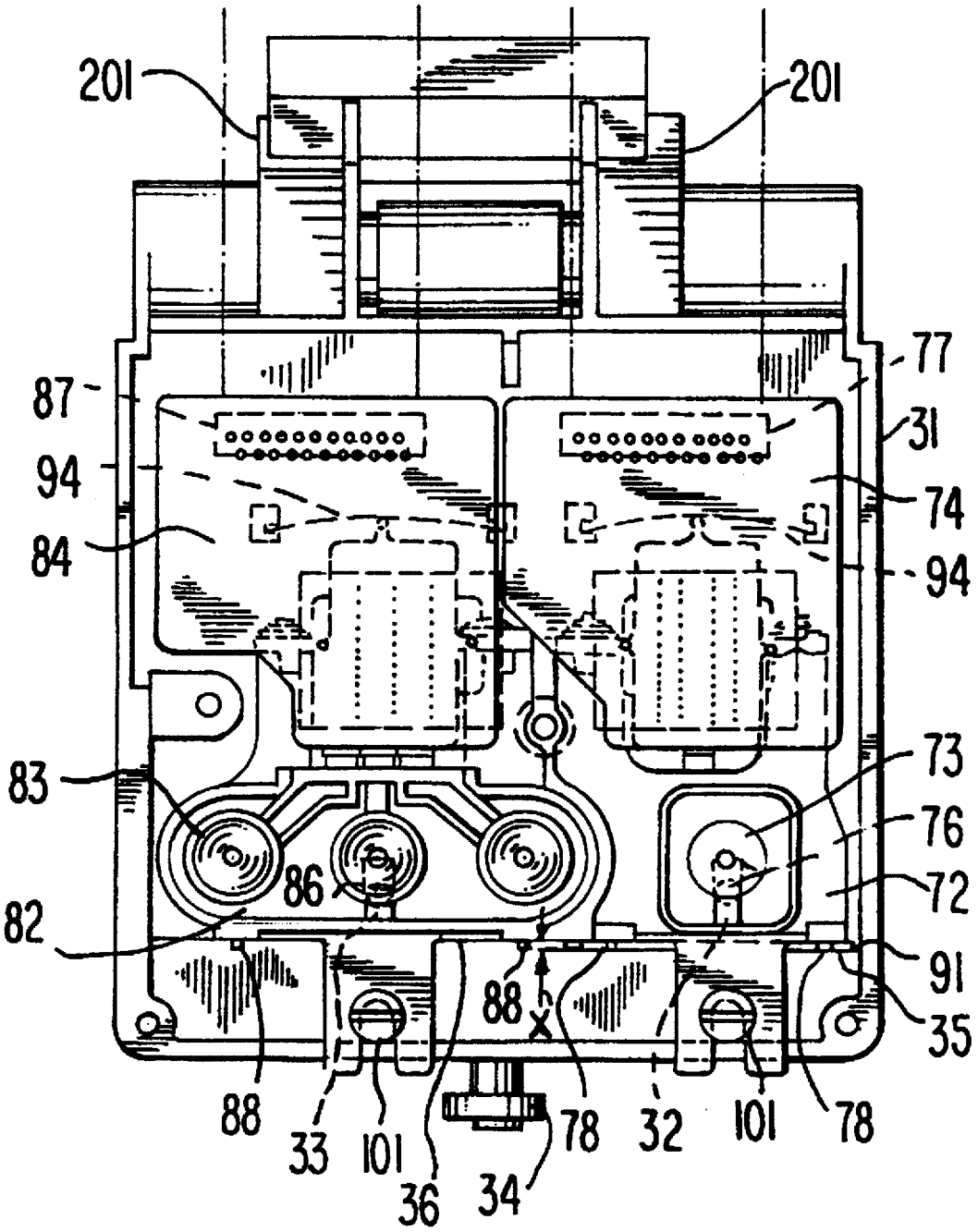
FIG. 3 is a top plan view of the portion of the color printer constructed in accordance with the present invention.

As shown in FIG. 2, rack **61*g* is disposed on the black cartridge 61, and a rack 62*g* is disposed on color ink cartridge 62. A gear 51*g* of lever 51 meshes with rack 61*g* and a gear 51*g* of the other lever 51 meshes with rack 62*g*. Each lever 51 is retainingly engaged, by a rib 51*a* overlapping a retaining portion 41*a* of the cartridge holder 41 to hold the ink cartridge 61, 62 in a loaded condition. For removing the ink cartridge 61, 62, the lever 51 is pivotally moved counterclockwise in the direction of arrow B (FIG. 2) about the lever shaft 52 against a retaining force of the retaining portion 41*a*, so that the gear 51*g* urges the rack 61*g*, 62*g*** upwardly.

Rotation correction plate 95 serves to adjust the angle of the nozzles 112 (122) of each of the black (70) and color (80) heads. An adjusting plate 91 (FIG. 3) adjusts a displacement of the black ink-jet head 70 and the color ink-jet head 80 in the direction of paper feed. As shown in FIGS. 5 and 6, a large hole **95*a* and a small hole 95*b* are formed through the rotation correction plate 95 to provide a single continuous hole, and this continuous hole is engaged with the hook portion 78 (88) formed on one abutment surface 75 (85) of the flow passage member 72 (82). Using one head 80 as a reference, the adjusting plate 91 is interposed between the other head positioning surface 36 and the abutment surface 85 of the head 80. The structure would also function using head 80 as the reference head and placing plate 91 on abutment surface 75**.

Next, correction of the angle between the nozzles 112, 122 and the abutment surface 75, 85 will now be described with respect to the case where the ink-jet head 70 and the ink-jet head 80 is attached independently of each other.

As shown in FIG. **4*a*, the plurality of parts, including the flow passage member 72, 82 the ink droplet discharge portion 71, 81 and the nozzles 112, 122, are provided over a range from the abutment surface 75, 85 to the row of nozzles 112, 122, and the sum of mechanical tolerances of these parts amounts to a considerable value. As a result, as shown in an exaggerated manner in FIG. 4*a*, the angle which should be 90° becomes an angle S° (head 70) and an angle T° (head 80**).

Therefore, the rotation correction plate 95, having a suitable thickness selected in accordance with this inclination, is attached as shown in FIG. **4*b*. For attaching the rotation correction plate 95, the large hole 95*a* in the rotation correction plate 95 is loosely fitted on the hook portion 78, 88 of the flow passage member 72, 82, respectively, and then the rotation correction plate 95 is slid in the direction of arrow C to fit the small hole 95*b* on the hook portion 78, 88. After the correction is thus effected, a surface of the rotation correction plate 95 functions as a new abutment surface corresponding to the abutment surface 75, 85, as shown in FIG. 4*b*. In this manner, when the ink jet head is positioned flushed against positioning surface 35, 36, rotation plate 95 rather than flow passage member 72, 82, contacts positioning surface 35, 36. The thickness of rotation plate 95 determines the angle at which the ink jet head abuts positioning surface 35, 36 adjusting the angle formed between nozzles 112, 122 and the abutment surface 75,85. If the abutment surface 75, 85 is disposed perpendicularly to the nozzles 112, 122 without the use of the rotation correction plate 95, the rotation correction plate 95** is naturally not used.

Next, the positioning of the ink-jet heads 70 and 80 with respect to the carriage 31 will now be described.

For positioning the heads in the direction of movement of the carriage 31, the engagement portions 76 and 86, formed respectively on the flow passage members 72 and 82 of the black ink-jet head 70 and color ink-jet head 80, are engaged respectively in the head guide grooves 32 and 33 formed in the carriage, thereby achieving the positioning. In this case, the head guide grooves 32 and 33 will not prevent the heads 70 and 80 from movement in the direction of feed of the paper.

For positioning the heads in the direction of feed of the paper, the abutment surfaces 85 of the color ink-jet head 80 are brought into intimate contact with the first head positioning surface 36 under the bias of the urging spring 94. In the color ink-jet head 80 mounted independently, the inclination of the abutment surfaces 85 with respect to the nozzles 122 has already been corrected, and therefore when the abutment surfaces 85 are held in intimate contact with the first head positioning surface 36 parallel to the carriage support shaft 23, the nozzles 122 are disposed perpendicular to the direction of movement of the carriage 31.

Then, in the black jet-ink head 70, the abutment surfaces 75 of the flow passage member 72 are brought into intimate contact with the second head positioning surface 35 under the bias of the urging spring 94. In the black ink-jet head 70 mounted independently, the inclination of the abutment surfaces 75 with respect to the nozzles 112 has already been corrected, and therefore when the abutment surfaces 75 are held in intimate contact with the second head positioning surface 35 parallel to the carriage support shaft 23, the nozzles 112 are disposed perpendicularly to the direction of scanning of the carriage 31.

For effecting color printing, the nozzle position of the black ink-jet head 70 and the nozzle position of the color ink-jet head 80 need to overlap each other on the recording medium in the direction of feed of the paper. The black ink-jet head 70 and the color ink-jet head 80 are constituted by their associated parts having manufacturing tolerances, and the inclination is corrected in an independent manner. Therefore, the two heads are naturally displaced relative to each other in the paper feed direction.

Therefore, in order to adjust displacement of the two heads in the paper feed direction, the adjusting plate 91 is used.

For effecting this adjustment, the black ink-jet head 70 and the color ink-jet head 80 are first provisionally fixed on the carriage 31 without the use of the adjusting plate 91, and then the printing is effected. An offset value (indicated by x in FIG. 3) is determined in view of the upper and lower limits of tolerances of the two heads and the maximum thickness of the inclination correction plate 95, and even if the row of nozzles 112 are most remote from the abutment surfaces 75 of the black ink-jet head 70, and the row of nozzles 122 are the nearest to the abutment surfaces 85 of the color ink-jet head 80, the row of nozzles 122 will not be more remote from carriage support shaft 23 than the row of nozzles 112 of the black ink-jet head 70 are, when the printing is effected without the use of the adjusting plate 91.

As a result of printing without the use of the adjusting plate 91, if black printing dots overlap color printing dots, the adjustment is finished. If such overlap is not achieved, the adjusting plate 91 of the smallest thickness is attached to one of the heads, using the other head as a reference, and then the printing is effected. In this embodiment, the printing density is 360 dots per inch, and therefore the distance between the dots is set to 0.07 mm, and the adjusting plate 91 of the smallest thickness is 0.07 mm thick, and the adjusting plate 91 of the second smallest thickness is 0.14 mm thick, thus providing adjusting plates 91 which differ in thickness by 0.07 mm from one another.

An adjustment resolution, achieved by such thickness difference of 0.07 mm, is a half of this thickness value, that is, 0.035 mm, and the overlap of two printing dots means that displacement of two printing dots with respect to each other is less than 0.005 mm which is the resolution of the adjusting plate 91. Therefore, if the black printing dots overlap the color printing dots with the use of the adjusting plate 91 of the smallest thickness, the adjustment is finished. If the printing dots do not overlap each other, the adjusting plates 91 of greater thicknesses are sequentially used one after another until the printing dots overlap each other. Thus, the adjustment can be carried out efficiently by displacing the one head while using the other head as a reference.

The distance from the recording medium 1 to a nozzle surface 111, 121 is determined by holding fastening portions of the flow passage member 72, 82 into intimate contact with a bottom surface of the carriage 31 by tightening screws 101. The distance from the recording medium 1 to the nozzles 112, 122 is short (usually on the order of about 1 mm), and also the speed of the ink droplets is high (usually on the order of about 10 m/sec), and therefore displacement of the printing dots due to variations in the distance is negligible.

The above adjustment are finished, and the black ink-jet head 70 and the color ink-jet head 80 are fixedly secured to the carriage 31, and then a final adjustment is effected. In this adjustment, the printing dots of the black ink-jet head 70 and color ink-jet head 80 are caused to overlap each other in the direction of movement of the carriage 31, and this adjustment is effected by a printing method, commonly used in serial printers, in which a printing timing signal in synchronism with the scanning of the carriage 31 is shifted. The printing timing is so adjusted in the control circuit of the printer body that the printing dots of the black ink-jet head 70 can overlap the printing dots (serving as a reference) formed on the recording medium 1 ink droplets of the color ink-jet head 80. thus, all of the adjustments are finished.

Although the mounting and adjustment of the two (black and color) ink-jet heads have been described above, the same mounting and adjustment can be used where two or more black ink-jet heads are provided, and also such mounting and adjustment can be used where the black and color ink-jet heads are exchanged.

As described above, in the present invention, the carriage has the head positioning surfaces parallel to the carriage support shaft, as well as the head guide groove perpendicular to the carriage support shaft, whereas the head has the engagement portion engaged in the head guide groove, and the abutment surfaces abutted against the head positioning surface. Therefore, merely by engaging the engagement portion of the head in the head guide groove in the carriage and by holding the abutment surfaces of the head in intimate contact with the head positioning surface of the carriage, the head can be accurately positioned in the paper feed direction without displacing the head in the direction of carriage movement.

In the type of printer having a plurality of ink-jet heads fixedly mounted on the carriage for the purpose of enhancing the printing speed or for the purpose of color printing, one head is attached to the positioning surface of the carriage, and other head is fixed, using the one head as a reference. With this method, the plurality of heads can be positioned highly precisely without requiring extremely severe dimensional accuracies of the component parts.

It will thus be seen that the objects set forth above among those made apparent from the preceding description, are efficiently attained and, since certain changes may be made in the above construction and method without departing from the spirit and the scope of the invention, it is intended that all matter contained in the above description and shown in the accompanying drawings shall be interpreted as illustrative and not in the limiting sense.

It is also to be understood that the following claims are intended to cover all the generic and specific features of the invention herein described and all statements of the scope of the invention which, as a matter of language, might be said to fall therebetween.

What is claimed is:

1. A head position adjusting mechanism for an ink-jet printer, comprising:

a carriage disposed in said ink-jet printer, said carriage moveable between a first position and a second position, a head positioning surface formed on said carriage for determining a head position in a direction of paper feed, said head positioning surface being parallel to a direction of carriage movement, said carriage having a head guide groove extending perpendicular to said direction of carriage movement;

a head including an engagement portion engaging said head guide groove to limit the movement of said head in direction of carriage movement, and an abutment surface spaced in the direction of carriage movement for contacting with said head positioning surface; and a spring mounted on said carriage for biasing said abutment surface of said head against said head positioning surface.

2. The head position adjusting mechanism for an ink-jet printer according to claim 1, wherein said carriage moves between said first position and second position in the direction of carriage movement, and said head further includes:

a nozzle surface with at least one nozzle opening defining a linear direction, and a rotation correction plate for adjusting said linear direction of said at least one nozzle opening to a position substantially perpendicular to said direction of carriage movement by compensating for an angle defined as the difference between a line drawn perpendicular to said direction of carriage movement and a line drawn parallel to said linear direction of said at least one nozzle opening.

3. The head position adjusting mechanism of claim 1, further comprising a second head positioning surface formed on said carriage and a second head mounted on said carriage, said second head having an abutment surface contacting with said second head positioning surface and at least one adjusting plate mounted between said abutment surface of said second head and second head positioning surface.

4. The head position adjustment mechanism of claim 3, wherein one of said head and said second head is a black ink jet print head and the other head is a color ink jet print head.

5. The head position adjusting mechanism for an ink-jet printer according to claim 3, wherein said carriage moves between said first position and second position in the direction of carriage movement and said second head further includes:

a nozzle surface with at least one nozzle opening defining a linear direction, and a rotation correction plate for adjusting said linear direction of said at least one nozzle opening to a position substantially perpendicular to said direction of carriage movement by compensating for an angle defined as the difference between a line drawn perpendicular to said direction of carriage movement and a line drawn parallel to said linear direction of said at least one nozzle opening.

6. A head position adjusting mechanism for an ink-jet printer, comprising:

a carriage disposed in said ink jet printer, said carriage moveable between a first position and a second position a head positioning surface formed on said carriage for determining a head position in a direction of paper feed, said head positioning surface being parallel to a direction of carriage movement, said carriage having a head guide groove extending perpendicular to said direction of carriage movement;

a head including an engagement portion engaged in said head guide groove to limit the movement of said head in the direction of carriage movement, and an abutment surface spaced in the direction of carriage movement for contacting with said head positioning surface;

a spring mounted in said carriage for biasing said abutment surface of said head against said head positioning surface;

a nozzle surface on said head with at least one nozzle opening defining a linear direction, and a rotation correction plate for adjusting said linear direction of said at least one nozzle opening to a position substantially perpendicular to said direction of carriage movement by compensating for an angle defined as the difference between a line drawn perpendicular to said direction of carriage movement and a line drawn parallel to said linear direction of said at least one nozzle opening;

a second head positioning surface formed on said carriage and a second head mounted on said carriage, said second head having an abutment surface contacting with said second head positioning surface and at least one adjusting plate mounted between said abutment surface of said second head and second head positioning surface.

7. A method for adjusting the position of a print head in an ink-jet printer in which a plurality of print heads are mounted on a carriage in a direction of movement of the carriage, said carriage having at least one head positioning surface and head guide groove, each of said plurality of print heads having an abutment surface and an engagement portion so that a respective abutment surface of each of said plurality of print heads engages an associated head positioning surface of said carriage, and that an engagement portion of each of said plurality of print heads is engaged in an associated head guide groove in said carriage, each of said plurality of print heads capable of supporting at least one adjustment plate, comprising the steps of:

(a) attaching at least one adjustment plate of selected thickness to one of said plurality of print heads to form an adjustment plate structure;

(b) printing with said plurality of print heads to determine whether said plurality of print heads are properly aligned, which is indicated when dots printed by one of said plurality of print heads overlap dots printed by a second of said plurality of print heads; and repeating steps a and b, and increasing the thickness of said adjustment plate structure by substituting an adjustment plate of different thickness in increments of selected thickness, until said plurality of print heads are properly aligned.

8. The method of adjusting the position of a print head of claim 7, wherein said abutment surface of each of said plurality of print heads includes at least one print nozzle and an attachment portion capable of supporting a rotation correction plate, comprising the steps of:

(c) attaching at least one rotation correction plate on said attachment portion of at least one of said plurality of heads to form a rotation correction plate structure;

(d) positioning the at least one of said print heads against the associated abutment surface of the at least one of said print heads;

(e) determining whether the position of said at least one print nozzle of the at least one of said print heads is perpendicular to the direction of movement of the carriage;

repeating steps c, d and e, and increasing the thickness of said rotation plate structure by substituting a rotation correction plate of different thickness until said at least one print nozzle is perpendicular to the direction of movement of the carriage.

9. The method of adjusting the position of a print head of claim 7, wherein biasing springs are mounted on said carriage, further comprising the step of biasing each of said abutment surfaces into contact with said associated head positioning surface with the biasing springs.

10. A method for adjusting the position of a print head in an ink-jet printer in which a plurality of print heads are mounted on a carriage in a direction of movement of the carriage, said carriage having at least one head positioning surface and head guide groove, and having biasing springs mounted thereon, each of said plurality of print heads having an abutment surface and an engagement portion so that a respective abutment surface of each of said plurality of print heads engages an associated head positioning surface of said carriage and an engagement portion of each of said plurality of print heads engages in an associated head guide groove in said carriage, each of said plurality of print heads being capable of supporting at least one adjustment plate, and said abutment surface of each of said plurality of print heads includes at least one print nozzle and an attachment portion capable of supporting a rotation correction plate, comprising the steps of:

(a) attaching at least one adjustment plate of selected thickness to one of said plurality of print heads to form an adjustment plate structure;

(b) printing with said plurality of print heads to determine whether said plurality of print heads are properly aligned, which is indicated when the dots printed by one of said plurality of print heads overlap dots printed by a second of said plurality of print heads;

repeating steps a and b, and increasing the thickness of said adjustment plate structure by substituting an adjustment plate of different thickness in increments of selected thickness, until said plurality of print heads are properly aligned;

(c) attaching said rotation correction plate on said attachment portion of at least one of said plurality of heads to form a correction plate structure;

(d) positioning said at least one of said print heads against said associated abutment surface of said at least one of said print heads;

(e) determining whether the position of said at least one print nozzle of said at least one of said print heads is perpendicular to the direction of movement of the carriage;

repeating steps c, d and e, and increasing the thickness of said rotation plate structure by substituting a rotation correction plate of different thickness until said print nozzles are perpendicular to the direction of movement of the carriage; and biasing each of said abutment surfaces into contact with said associated head positioning surface.

11. A method of adjusting the position of a print head in an ink-jet printer in which a plurality of print heads are mounted on a carriage in a direction of movement of the carriage, said carriage having at least one head positioning surface and head guide groove, each of said plurality of print heads having an abutment surface and an engagement portion so that a respective abutment surface of each of said plurality of print heads engages an associated head positioning surface of said carriage and an engagement portion of each of said plurality of print heads engages in an associated head guide groove in said carriage, each of said of said plurality of print heads capable of supporting at least one adjustment plate, and said abutment surface of each of said plurality of print heads includes at least one print nozzle and an attachment portion capable of supporting a rotation correction plate, comprising the steps of:

(a) attaching a rotation correction plate on said attachment portion of at least one of said plurality of heads to form a rotation plate structure;

(b) positioning said at least one of said print heads against said associated abutment surface of said at least one of said print heads;

(c) determining whether the position of said at least one print nozzle of said at least one of said print heads is perpendicular to the direction of movement of the carriage;

repeating steps a, b and c, and increasing the thickness of said rotation plate structure by substituting a rotation correction plate of different thickness until said at least one print nozzle is perpendicular to the direction of movement of the carriage.

* * * * *